US008662219B2

(12) United States Patent
Saitou

(10) Patent No.: US 8,662,219 B2
(45) Date of Patent: Mar. 4, 2014

(54) WORK VEHICLE

(75) Inventor: Hiroshi Saitou, Kanazawa (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/811,741

(22) PCT Filed: Aug. 9, 2012

(86) PCT No.: PCT/JP2012/070331

§ 371 (c)(1),
(2), (4) Date: Jan. 23, 2013

(65) Prior Publication Data

US 2014/0020965 A1 Jan. 23, 2014

(30) Foreign Application Priority Data

Jul. 19, 2012 (JP) ..... 2012-160416

(51) Int. Cl.
*B60K 17/28* (2006.01)

(52) U.S. Cl.
USPC ..... 180/53.4; 188/170; 180/305

(58) Field of Classification Search
USPC ..... 180/53.4, 89.1, 305, 308; 188/170; 414/685
See application file for complete search history.

(56) References Cited

U.S. PATENT DOCUMENTS

| | | | | |
|---|---|---|---|---|
| 6,129,368 | A * | 10/2000 | Ishikawa | 280/124.112 |
| 7,717,218 | B2 * | 5/2010 | Matsumoto et al. | 180/291 |
| 8,225,901 | B2 * | 7/2012 | Ohtsuki et al. | 180/312 |

FOREIGN PATENT DOCUMENTS

| | | |
|---|---|---|
| JP | 8-14533 | 1/1996 |
| JP | 10-280475 | 10/1998 |
| JP | 2005-90095 | 4/2005 |
| JP | 2006-132092 A | 5/2006 |
| JP | 2006-274596 | 10/2006 |
| JP | 2007-131091 | 5/2007 |
| JP | 2008-045307 A | 2/2008 |
| WO | 2011/145684 | 11/2011 |

* cited by examiner

*Primary Examiner* — Karen Beck
(74) *Attorney, Agent, or Firm* — Drinker Biddle & Reath LLP

(57) ABSTRACT

A wheel loader (1) has a tire (5). The wheel loader (1) includes a hydraulic pump (11), a hydraulic oil tank (7) disposed at a position higher than the hydraulic pump (11) and connected to the hydraulic pump (11), a check valve (12) disposed at a position lower than the hydraulic oil tank (7) and connected to the hydraulic oil tank (7), a filter (13) disposed at a position lower than an upper surface (US) of the tire (5) in a side view and connected to the check valve (12), and a pipe (14) extending to a first position (H1) lower than the check valve (12) and further extending from the first position (H1) to a second position (H2) as a higher position than the check value (12) is set as the second position (H2), and connected to the filter (13) at the second position (H2). Accordingly, it is possible to provide a work vehicle capable of inhibiting a hydraulic oil from spilling out in exchanging the filter (13).

8 Claims, 8 Drawing Sheets

WORK VEHICLE

TECHNICAL FIELD

The present invention relates to a work vehicle, and particularly relates to a work vehicle having a hydraulic oil tank.

BACKGROUND ART

A hydraulic oil tank in a work vehicle is mounted with a filter configured to filter a hydraulic oil. For example, Japanese Patent Laying-Open No. 10-280475 (PTL 1) has disclosed a hydraulic oil tank having a filter housed in a return chamber.

CITATION LIST

Patent Literature

PTL 1: Japanese Patent Laying-Open No. 10-280475

SUMMARY OF INVENTION

Technical Problem

In the above disclosure, the filter is disposed inside the hydraulic oil tank. Meanwhile, the filter may be connected to the hydraulic oil tank at a position separated from the hydraulic oil tank. In addition, the hydraulic oil tank may be disposed at a position higher than the filter. In the case where the filter is connected to the hydraulic oil tank at a position separated from the hydraulic oil tank and the hydraulic oil tank is disposed at a position higher than the filter, when the filter is removed to be exchanged, hydraulic oil drops down from a portion where the filter is removed. Thereby, there arises a problem that the hydraulic oil spills in exchanging the filter.

Conventionally, a method to be described hereinafter is applied to solve such problem. As illustrated in FIG. 8, according to the method, a check valve 22 is connected between a hydraulic oil tank 7 and a filter 23. Check valve 22 is disposed at a position higher than filter 23 by a height X. Owing to check valve 22, the hydraulic oil between hydraulic oil tank 7 and check valve 22 is prevented from dropping down from check valve 22. Since check valve 22 has a valve body that seals itself by a weight thereof, one end of check valve 22 is positioned at a higher position and the other end thereof is positioned at a lower position. Therefore, if filter 23 is removed, the hydraulic oil in a pipe 24 disposed between the lower end of check valve 22 and filter 23 drops down from pipe 24. Thereby, even according to this method, the hydraulic oil still spills out in exchanging filter 23.

The present invention has been accomplished in view of the aforementioned problems, and it is therefore an object of the present invention to provide a work vehicle capable of inhibiting a hydraulic oil from spilling out in exchanging a filter.

Solution to Problem

The work vehicle of the present invention has a tire. The work vehicle of the present invention includes a hydraulic pump, a hydraulic oil tank disposed at a position higher than the hydraulic pump and connected to the hydraulic pump, a check valve disposed at a position lower than the hydraulic oil tank and connected to the hydraulic oil tank, a filter disposed at a position lower than an upper surface of the tire in a side view and connected to the check valve, and a pipe extending to a first position lower than the check valve and further extending from the first position to a second position as a higher position than the check value is set as the second position, and connected to the filter at the second position.

According to the work vehicle of the present invention, the check valve is disposed at a position lower than the hydraulic oil tank, and the pipe extends to the first position lower than the check valve, extends from the first position to the second position higher than the check value and is connected to the filter at the second position. Since the pipe is connected to the filter at the second position higher than the check valve, it is possible to prevent the hydraulic oil in the pipe located between the check valve and the second position from spilling out in exchanging the filter.

Further, since the hydraulic oil tank is disposed at a position higher than the hydraulic pump, the hydraulic oil flows into the hydraulic pump by gravity. Thereby, it is possible to reduce a pressure needed by the hydraulic pump to draw the hydraulic oil, and consequently to relieve a load applied to the hydraulic pump.

Furthermore, since the filter is disposed at a position lower than the upper surface of the tire in a side view, it is possible for a service person to perform the service of exchanging filter with the ground as a foothold. Thereby, it is possible to improve the ease of maintenance.

In the work vehicle mentioned above, the pipe constitutes an oil accumulation member after the filter is removed. Thereby, after the filter is removed, the hydraulic oil accumulates in the oil accumulation member, and accordingly, it is possible to inhibit the hydraulic oil from spilling out from the pipe.

In the work vehicle mentioned above, the pipe is connected to an upper surface of the filter. The hydraulic oil accumulates at a lower side of the filter, and therefore, by connecting the pipe to the upper surface of the filter, it is possible to inhibit the hydraulic oil from spilling out from the filter in exchanging the filter.

In the work vehicle mentioned above, the pipe is connected to a side surface of the filter. Thereby, without directing a tip end of the pipe downward, it is possible to connect the pipe to the filter. Accordingly, it is possible to inhibit the hydraulic oil from spilling out from the pipe in exchanging the filter.

In the work vehicle mentioned above, the check valve includes a housing having a through hole and a valve body capable of sealing the through hole by a deadweight thereof. Thereby, it is possible to seal the through hole of the housing by the deadweight of the valve body in exchanging the filter.

The work vehicle mentioned above further includes a hydraulic actuator. The hydraulic actuator is connected to the hydraulic pump and constitutes a part of a hydraulic circuit connected to the filter. In the hydraulic circuit, the hydraulic oil of the hydraulic oil tank is delivered to the hydraulic actuator by the hydraulic pump, and the hydraulic oil from the hydraulic actuator flows back to the hydraulic oil tank through the filter and the check valve. Thereby, it is possible to deliver the hydraulic oil to the hydraulic actuator by the hydraulic pump, and it is possible to filter the hydraulic oil delivered to the hydraulic actuator by the filter and thereafter to return the filtered hydraulic oil back to the hydraulic oil tank. Accordingly, it is possible to circulate the hydraulic oil filtered by the filter.

In the work vehicle mentioned above, the hydraulic pump is disposed at a position higher than the filter and the check valve. Thereby, it is possible for the hydraulic oil to flow smoothly in the gravity direction from the hydraulic pump to the hydraulic actuator and from the hydraulic actuator to the filter.

The work vehicle mentioned above further includes a cab and an engine compartment. The hydraulic oil tank is disposed posterior to the cab and anterior to the engine compartment. Since engine heat is discharged posterior to the engine compartment by a cooling fan, it is possible to have the hydraulic oil tank disposed at a location having a relatively lower ambient temperature.

Advantageous Effects of Invention

According to the present invention as mentioned above, it is possible to inhibit the hydraulic oil from spilling out in exchanging the filter.

DESCRIPTION OF EMBODIMENTS

Hereinafter, an embodiment of the present invention will be described with reference to the drawings.

First, the configuration of a wheel loader serving as a work vehicle in one embodiment of the present invention will de described.

Figure 1:
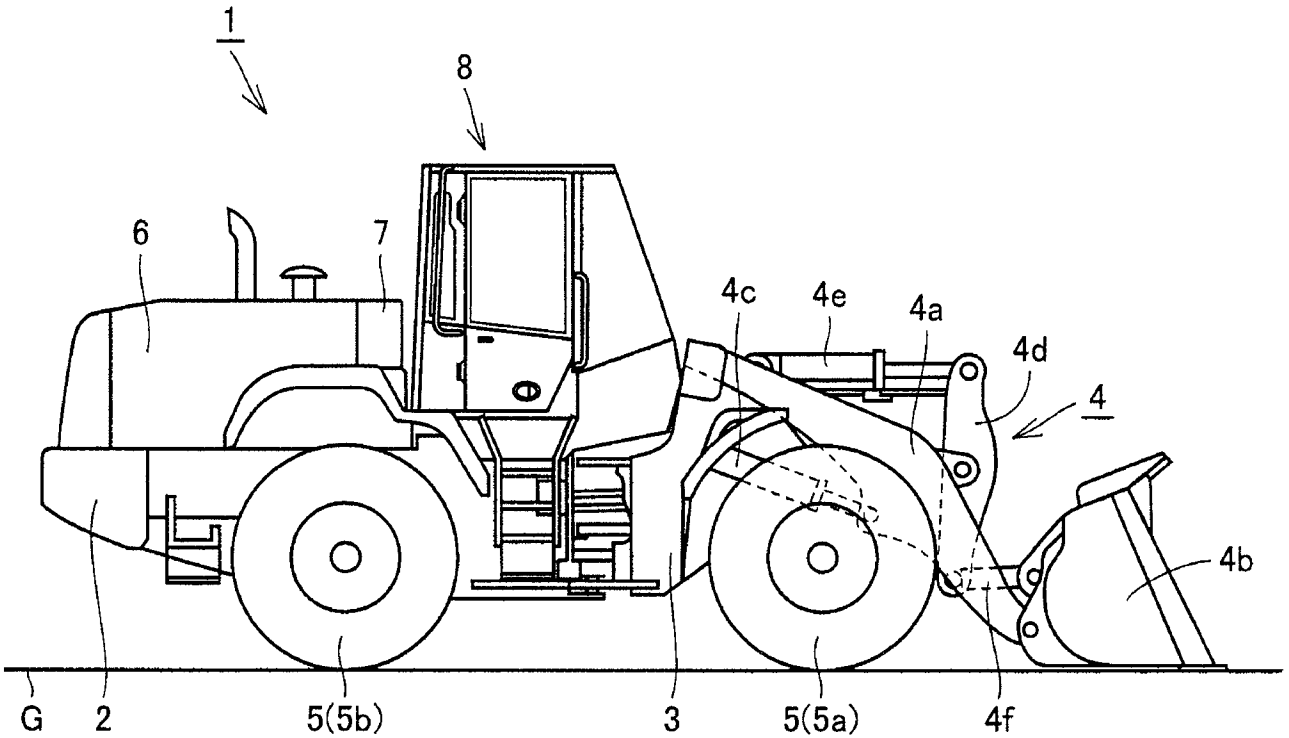
FIG. 1 is a side view schematically illustrating a configuration of a wheel loader according to an embodiment of the present invention.

With reference to FIG. 1, a wheel loader 1 of the present embodiment is generally composed of a rear body part 2, a front body part 3, a work implement 4, and a tire 5. Tire 5 is configured to be rotatable and includes a front wheel 5*a* and a rear wheel 5*b*. Front wheel 5*a* is mounted at each of both sides of front body part 3, and rear wheel 5*b* is mounted at each of both sides of rear body part 2.

Rear body part 2 and front body part 3 are mounted in a way of being able to swing freely from side to side about a center pin CP (see FIG. 2), to form an articulated structure. Specifically, rear body part 2 and front body part 3 are connected together by a pair of laterally-disposed steering cylinders (not shown), and are configured to swing laterally about the center pin in accordance with telescopic motions of the laterally-disposed steering cylinders so as to perform the steering. Rear body part 2 and front body part 3 constitute the body of wheel loader 1.

Work implement 4 is mounted at the front of front body part 3. Work implement 4 is provided with a boom 4*a* having a base end section thereof swingably mounted at front body part 3 and a bucket 4*b* swingably mounted at a tip end section of boom 4*a*. Front body part 3 and boom 4*a* are connected through a pair of boom cylinders 4*c* and 4*c*. Boom 4*a* is configured to swing in accordance with the telescopic motions of boom cylinders 4*c* and 4*c*.

Work implement 4 is further provided with a bell crank 4*d* having a substantially central section thereof swingably supported on boom 4*a*, a bucket cylinder 4*e* configured to connect a base end section of bell crank 4*d* and front body part 3, and a link 4*f* configured to connect a tip end section of bell crank 4*d* and bucket 4*b*. Bucket 4*b* is configured to swing in accordance with the telescopic motions of bucket cylinder 4*e*.

An engine compartment 6 is disposed at a posterior portion of rear body part 2. A hydraulic oil tank 7 is disposed anterior to engine compartment 6. In front of hydraulic oil tank 7, there is disposed a cab 8 for an operator to enter therein to operate wheel loader 1. In the embodiment, an anteroposterior direction and a lateral direction of wheel loader 1 are defined on the basis of the operator sitting in cab 8.

Subsequently, with reference to FIG. 2, a hydraulic circuit of wheel loader 1 according to the present embodiment will be described. The hydraulic circuit of wheel loader 1 includes hydraulic oil tank 7, a hydraulic pump 11, a check valve 12, a filter 13, a hydraulic valve 15, and a hydraulic actuator OA. Specifically, hydraulic actuator OA refers to boom cylinder 4*c* and bucket cylinder 4*e*.

Hydraulic oil tank 7 is disposed at a position higher than an upper surface US of tire 5. Upper surface US of tire 5 is a plane located at the highest position of tire 5 when wheel loader 1 is seated on a leveled ground G (see FIG. 1). Hydraulic oil tank 7 is disposed at a position higher than hydraulic pump 11. Hydraulic oil tank 7 is connected to hydraulic pump 11. Hydraulic pump 11 is, for example, a piston pump. Hydraulic pump 11 is disposed at a position higher than both check valve 12 and filter 13.

Check valve 12 is disposed at a position lower than hydraulic oil tank 7. Check valve 12 is connected to hydraulic oil tank 7. Check valve 12 is, for example, a poppet valve.

Filter 13 is disposed at a position lower than upper surface US of tire 5 in the side view. Filter 13 is connected to check valve 12. Filter 13 is exchangeably mounted at a head section 13*a*.

Pipe 14 connects check valve 12 and filter 13. Pipe 14 extends to a first position H1 lower than check valve 12. In the case where a position higher than check valve 12 is set as a second position H2, pipe 14 extends from first position H1 to second position H2 and is connected to filter 13 at second position H2. Pipe 14 further extends higher than second position H2 and is connected to an upper surface of head section 13*a*. Pipe 14 constitutes an oil accumulation member after filter 13 is removed.

Filter 13 is connected to hydraulic actuator OA with hydraulic valve 15 interposed therebetween. Specifically, filter 13 is connected through hydraulic valve 15 to boom cylinder 4*c* and bucket cylinder 4*e*, respectively.

Meanwhile, hydraulic pump 11 is connected through hydraulic valve 15 to boom cylinder 4*c* and bucket cylinder 4*e*, respectively.

Figure 2:
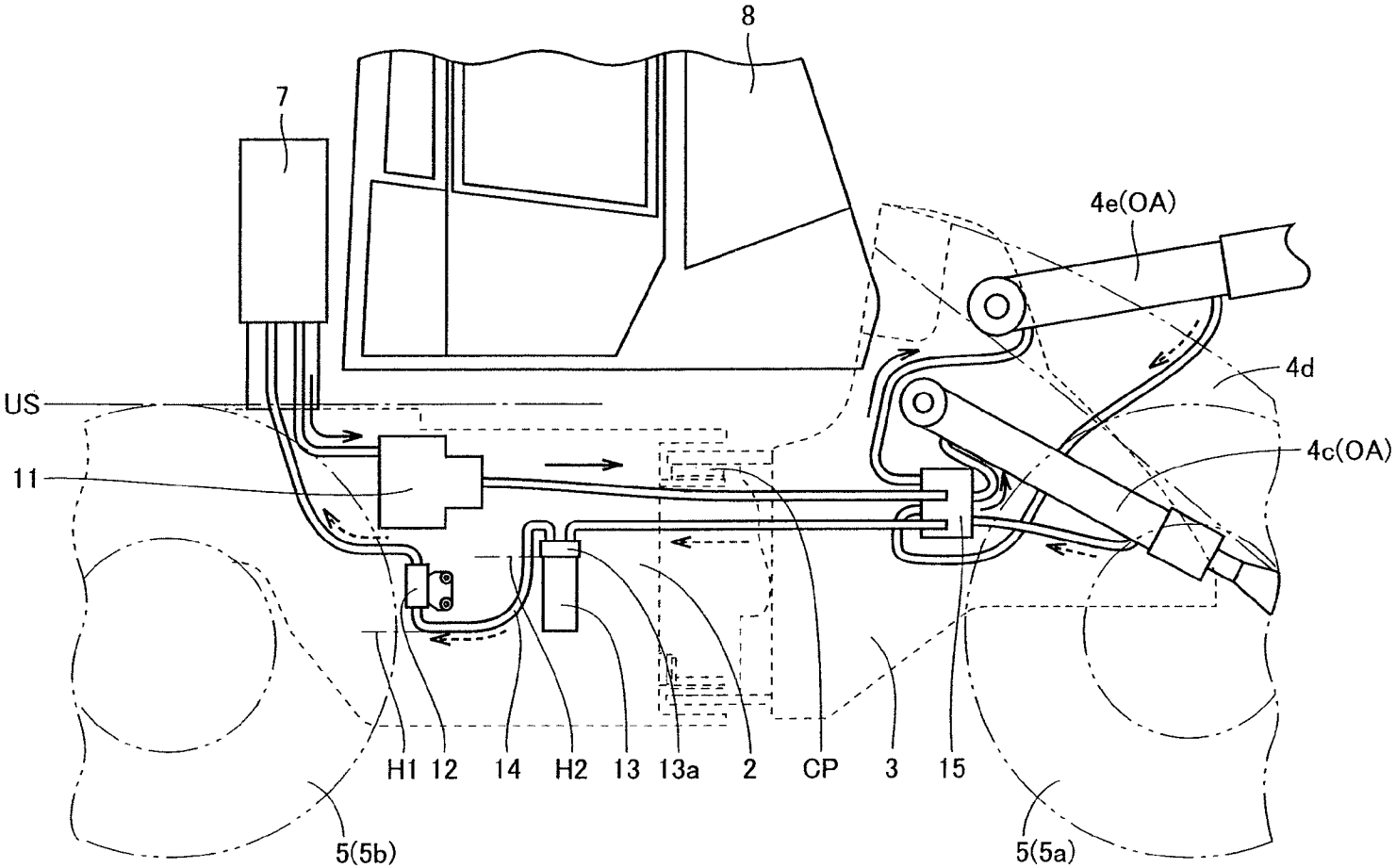
FIG. 2 is a side view schematically illustrating a hydraulic circuit of the wheel loader according to an embodiment of the present invention.

In the hydraulic circuit of wheel loader 1, as illustrated by the solid arrows in FIG. 2, the hydraulic oil in hydraulic oil tank 7 is delivered through hydraulic valve 15 to boom cylinder 4*c* and bucket cylinder 4*e* by hydraulic pump 11. Boom cylinder 4*c* and bucket cylinder 4*e* constitute a part of the hydraulic circuit. Such circuit configured to deliver the hydraulic oil from hydraulic oil tank 7 to hydraulic actuator OA constitutes a supply circuit of the hydraulic circuit.

As illustrated by the dashed arrows in FIG. 2, the hydraulic oil in boom cylinder 4*c* and bucket cylinder 4*e* is delivered to filter 13 through hydraulic valve 15. Then, the hydraulic oil is delivered from filter 13 through pipe 14 to check valve 12. Thereafter, the hydraulic oil is delivered from check valve 12 to hydraulic oil tank 7. Such circuit configured to deliver the hydraulic oil from hydraulic actuator OA to hydraulic oil tank 7 constitutes a return circuit of the hydraulic circuit.

Figure 3:
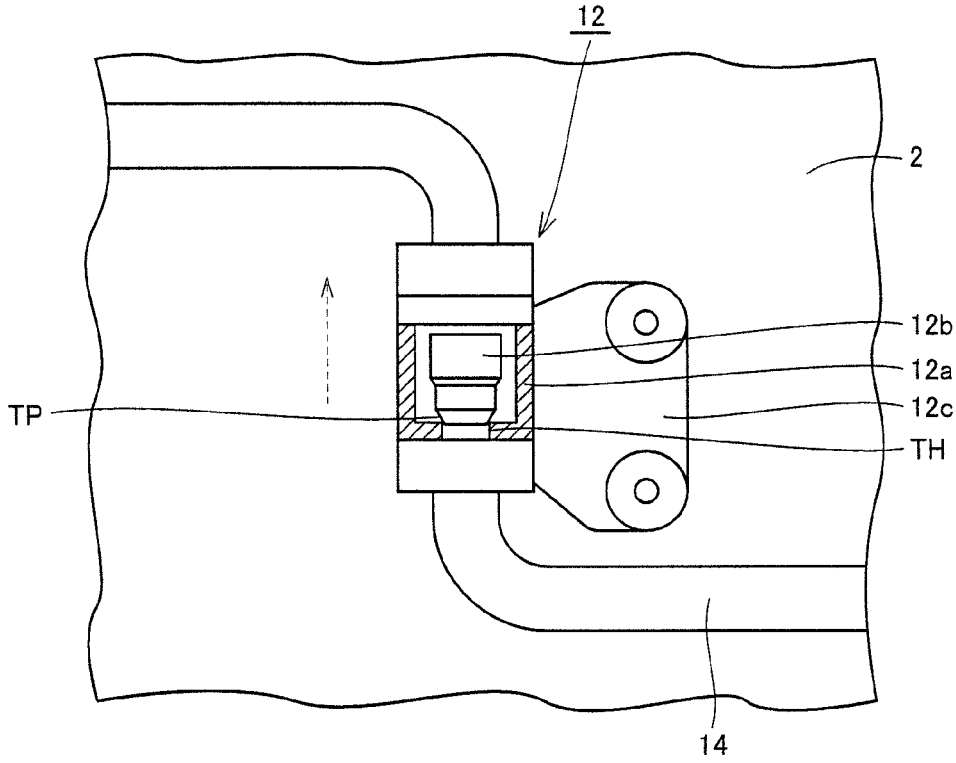
FIG. 3 is a partial section view schematically illustrating a configuration of a check valve according to an embodiment of the present invention.

Subsequently, with reference to FIG. 3, the structure of check valve 12 in the present embodiment will be described in detail. Check valve 12 includes a housing 12*a*, a valve body 12*b* and a mounting bracket 12*c*. Housing 12*a* has an internal space, and valve body 12*b* is housed in the internal space. Housing 12*a* has a through hole TH. Through hole TH is formed in a bottom surface of housing 12*a*. Housing 12*a* communicates with pipe 14 via through hole TH.

Valve body 12*b* is configured to be movable in the internal space of housing 12*a* by the hydraulic oil. Valve body 12*b* is configured to be able to seal through hole TH in housing 12*a* by its deadweight. FIG. 3 illustrates a state where through hole TH is sealed by valve body 12*b*. Valve body 12*b* has a tapered portion TP which is engageable with through hole TH. Through hole TH is sealed as tapered portion TP is in engagement with through hole TH. In this state, in addition to the deadweight of valve body 12*b*, the weight of the hydraulic oil also presses valve body 12*b* downward.

On the other hand, in the state where through hole TH is not sealed by valve body 12*b*, the hydraulic oil flows through a gap formed between through hole TH and tapered portion TP. In detail, as illustrated by the dashed arrow in FIG. 3, the hydraulic oil flows from a lower side of check valve 12 toward an upper side thereof. Check valve 12 is mounted at rear body part 2 via mounting bracket 12*c*.

Figure 4:
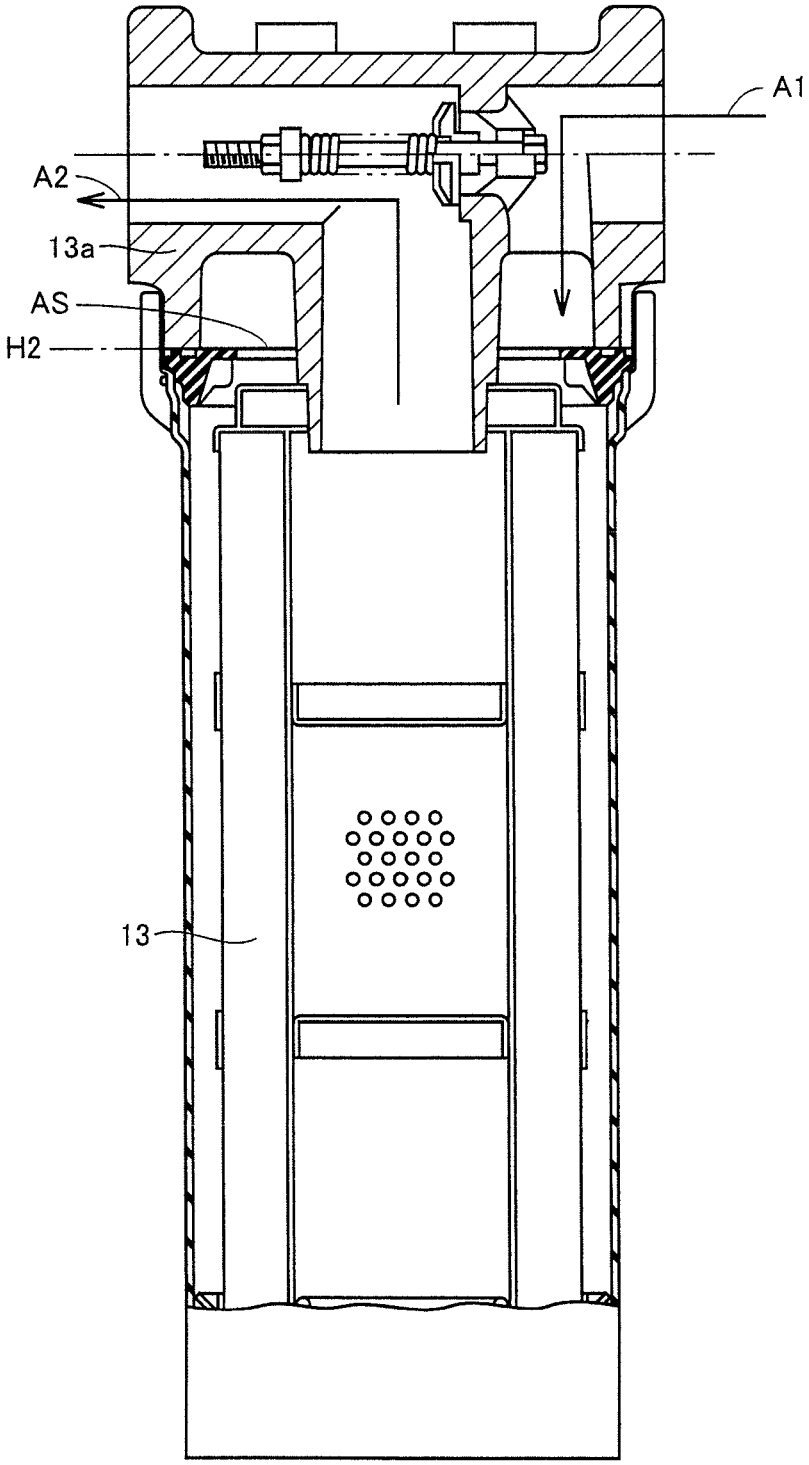
FIG. 4 is a partially cut-away side view schematically illustrating a configuration of a filter according to an embodiment of the present invention.

Hereinafter, with reference to FIG. 4, the structure of filter 13 in the present embodiment will be described in detail. Filter 13 is mounted at head section 13*a*. A mounting surface AS of filter 13 constitutes the upper surface of filter 13. The position of mounting surface AS of filter 13 serves as second position H2. Head section 13*a* is connected to pipe 14 (see FIG. 2). In FIG. 4, pipe 14 is not illustrated for clear visualization. Filter 13 is removed from head section 13*a* at mounting surface AS.

As illustrated by arrow A1 in FIG. 4, the hydraulic oil flowed into head section 13*a* is delivered to filter 13. As the hydraulic oil passes through filter 13, contamination substances mixed into the hydraulic oil are collected by filter 13. Thus, contamination substances contained in the hydraulic oil are removed by filtering the hydraulic oil with filter 13.

Figure 5:
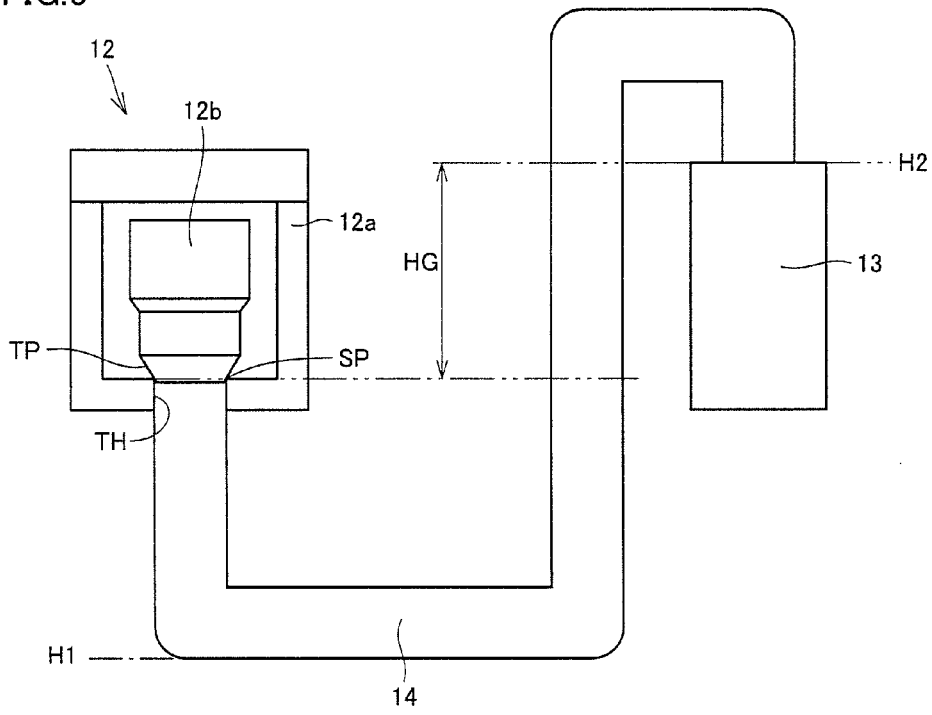
FIG. 5 is a view schematically illustrating a position relationship between the check valve and the filter according to an embodiment of the present invention.

Subsequently, with reference to FIG. 5, the connection relationship between check valve 12 and filter 13 will be described in detail. Through hole TH is sealed by embedding tapered portion TP of valve body 12*b* into through hole TH disposed in housing 12*a* of check valve 12. In this situation, through hole TH is sealed at a point (sealing point) SP where tapered portion TP contacts through hole TH. For convenient description, the head section, and the pipe from the hydraulic actuator to filter 13 are not illustrated in FIG. 5.

Pipe 14 extends from first position H1 lower than check valve 12 to second position H2 higher than check valve 12, and is connected to filter 13 at second position H2. Second position H2 is located at a position higher than sealing point SP by a height HG.

Figure 6:
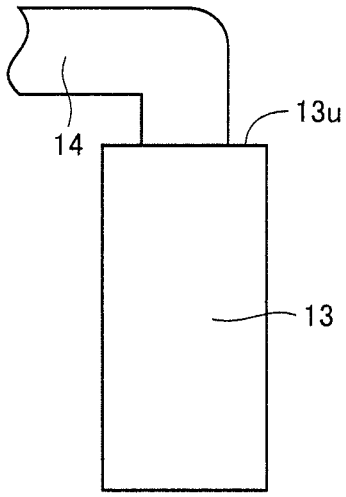
FIG. 6 is a view schematically illustrating a connection position between the filter and a pipe according to an embodiment of the present invention.
Figure 7:
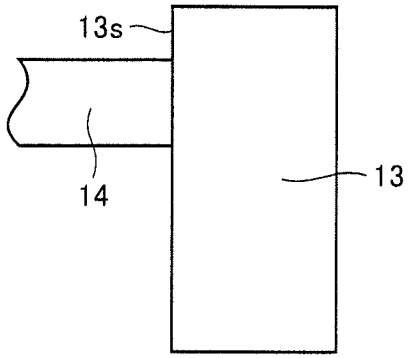
FIG. 7 is a view schematically illustrating a connection position between the filter and the pipe according to a modification of an embodiment of the present invention.
Figure 8:
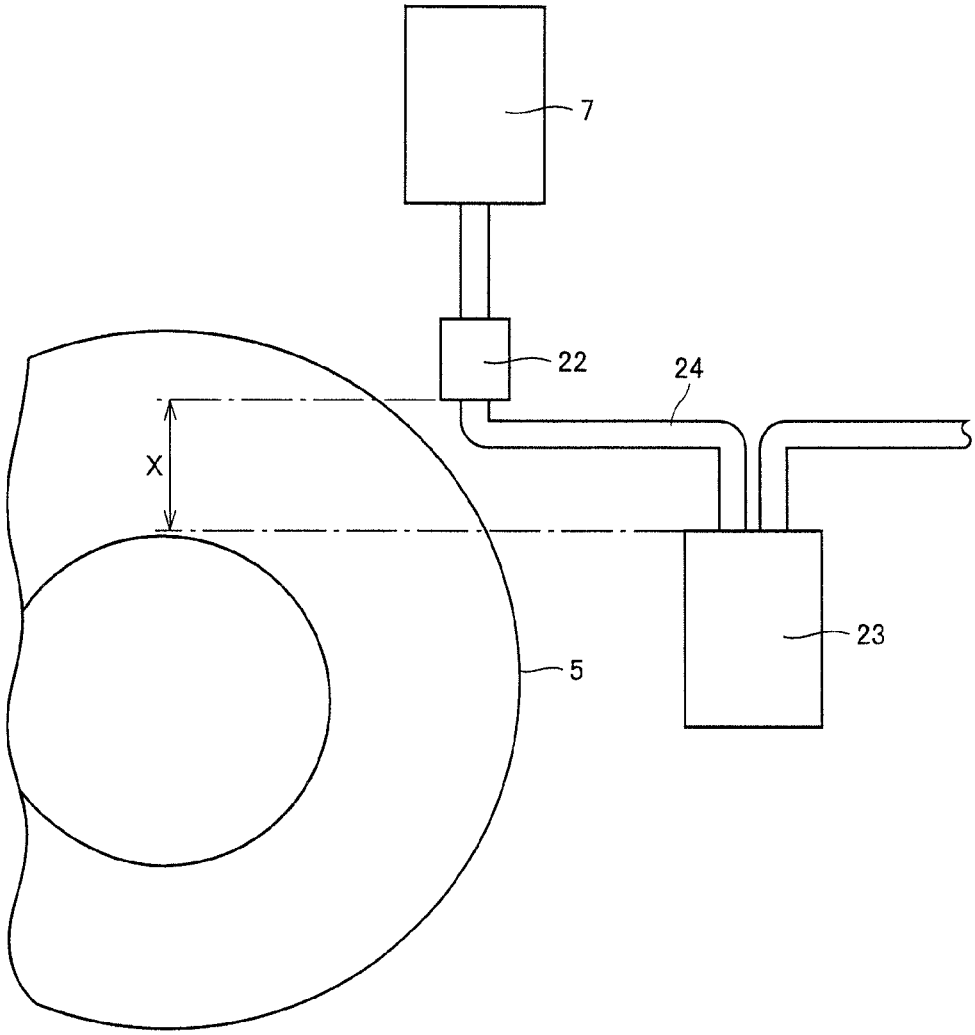
FIG. 8 is a view schematically illustrating a position relationship among the hydraulic tank, the check valve and the filter in a conventional art.

With reference to FIG. 6 and FIG. 7, the connection position of pipe 14 relative to filter 13 will be described. For convenient description, the head section is not illustrated in FIG. 6 and FIG. 7. As illustrated in FIG. 6, in the present embodiment, pipe 14 is connected to an upper surface 13*u* of filter 13.

The connection position of pipe 14 relative to filter 13 is not limited to upper surface 13*u* of the filter. As illustrated in FIG. 7, in a modification of the present embodiment, pipe 14 is connected to a side surface 13*s* of filter 13.

Hereinafter, functions and effects of the present embodiment will be described.

As illustrated in FIG. 2, according to wheel loader 1 of the present embodiment, check valve 12 is disposed at a position lower than hydraulic oil tank 7, and pipe 14 is connected to check valve 12 in such a manner that pipe 14 extends to first position H1 lower than check valve 12. Moreover, pipe 14 extends from first position H1 to second position H2 higher than check valve 12 and is connected to filter 13 at second position H2. Since pipe 14 is connected to filter 13 at second position H2 higher than check valve 12, it is possible to inhibit the hydraulic oil inside pipe 14 between check valve 12 and second position H2 from spilling out in exchanging filter 13.

Further, since hydraulic oil tank 7 is disposed at a position higher than hydraulic pump 11, the hydraulic oil flows into hydraulic pump 11 by gravity. Thereby, it is possible to reduce a pressure needed by hydraulic pump 11 to draw the hydraulic oil, and consequently to relieve a load applied to hydraulic pump 11.

Furthermore, since filter 13 is disposed at a position lower than upper surface US of tire 5 in the side view, it is possible for a service person to perform the service of exchanging filter 13 with ground G as a foothold. Thereby, it is possible to improve the ease of maintenance.

In wheel loader 1 of the present embodiment, pipe 14 constitutes the oil accumulation member after filter 13 is removed. Thereby, after filter 13 is removed, the hydraulic oil accumulates in the oil accumulation member, and accordingly, it is possible to inhibit the hydraulic oil from spilling out from pipe 14.

In wheel loader 1 of the present embodiment, pipe 14 is connected to upper surface 13*u* (see FIG. 6) of filter 13. The hydraulic oil accumulates at a lower side of filter 13, and therefore, by connecting pipe 14 to upper surface 13*u* of filter 13, it is possible to inhibit the hydraulic oil from spilling out from filter 13 in exchanging filter 13.

In the modification of wheel loader 1 of the present embodiment, pipe 14 is connected to side surface 13*s* (see FIG. 7) of filter 13. Thereby, without directing a tip end of pipe 14 downward, it is possible to connect pipe 14 to filter 13. Accordingly, it is possible to inhibit the hydraulic oil from spilling out from pipe 14 in exchanging filter 13.

In wheel loader 1 of the present embodiment, check valve 12 includes valve body 12*b* capable of sealing through hole TH of housing 12*a* by its deadweight. Thereby, it is possible to seal the through hole of housing 12*a* by the deadweight of valve body 12*b* in exchanging filter 13.

In wheel loader 1 of the present embodiment, boom cylinder 4*c* and bucket cylinder 4*e* are connected respectively to filter 13 through hydraulic valve 15, and hydraulic pump 11 is connected through hydraulic valve 15 to boom cylinder 4*c* and bucket cylinder 4*e*, respectively. Thereby, it is possible to deliver the hydraulic oil to boom cylinder 4*c* and bucket cylinder 4*e* respectively by means of hydraulic pump 11, and it is possible to filter at filter 13 the hydraulic oil delivered respectively to boom cylinder 4*c* and bucket cylinder 4*e* and to return the filtered hydraulic oil back to hydraulic oil tank 7. Accordingly, it is possible to circulate the hydraulic oil after filtered by filter 13.

In wheel loader 1 of the present embodiment, hydraulic pump 11 is disposed at a position higher than filter 13 and check valve 12. Thereby, it is possible for the hydraulic oil to flow smoothly from hydraulic pump 11 to hydraulic actuator OA and from hydraulic actuator OA to filter 13 in the gravity direction.

In wheel loader 1 of the present embodiment, hydraulic oil tank 7 is disposed posterior to cab 8 and anterior to engine compartment 6. Since engine heat is released posterior to engine compartment 6 by a cooling fan, it is possible to have hydraulic oil tank 7 disposed at a location having a relatively lower ambient temperature.

It should be understood that the embodiments disclosed herein have been presented for the purpose of illustration and description but not limited in all aspects. It is intended that the scope of the present invention is not limited to the description above but defined by the scope of the claims and encompasses all modifications equivalent in meaning and scope to the claims.

INDUSTRIAL APPLICABILITY

The present invention is advantageously applicable to a work vehicle having a hydraulic oil tank in particular.

REFERENCE SIGNS LIST

1: wheel loader; 2: rear body part; 3: front body part; 4: work implement; 4*a*: boom; 4*b*: bucket; 4*c*: boom cylinder; 4*d*: bell crank; 4*e*: bucket cylinder; 4*f*: link; 5: tire; 5*a*: front wheel; 5*b*: rear wheel; 6: engine compartment; 7: hydraulic oil tank; 8: cab; 11: hydraulic pump; 12, 22: check valve; 12*a*: housing; 12*b*: valve body; 12*c*: mounting bracket; 13, 23: filter; 13*a*: head part; 13*s*: side surface; 13*u*: upper surface; 14, 24: pipe; 15: hydraulic valve, AS: mounting surface; CP: central pin; G: ground; H1: first position; H2: second position; OA: hydraulic actuator; SP: sealing point; TH: through hole; TP: tapered portion; US: upper surface

The invention claimed is:

1. A work vehicle having a tire, comprising:

a hydraulic pump;

a hydraulic oil tank disposed at a position higher than said hydraulic pump and connected to said hydraulic pump;

a check valve disposed at a position lower than said hydraulic oil tank and connected to said hydraulic oil tank;

a filter disposed at a position lower than an upper surface of said tire in a side view and connected to said check valve; and a pipe extending to a first position lower than said check valve and further extending from said first position to a second position as a higher position than said check value is set as said second position, and connected to said filter at said second position.

2. The work vehicle according to claim 1, wherein said pipe constitutes an oil accumulation member after said filter is removed.

3. The work vehicle according to claim 1, wherein said pipe is connected to an upper surface of said filter.

4. The work vehicle according to claim 1, wherein said pipe is connected to a side surface of said filter.

5. The work vehicle according to claim 1, wherein said check valve includes a housing having a through hole, and a valve body sealing said through hole of said housing by a weight of the valve body.

6. The work vehicle according to claim 1, further comprising a hydraulic actuator, wherein said hydraulic actuator is connected to said hydraulic pump and constitutes a part of a hydraulic circuit connected to said filter, and in said hydraulic circuit, a hydraulic oil of said hydraulic oil tank is delivered to said hydraulic actuator by said hydraulic pump, and the hydraulic oil from said hydraulic actuator flows back to said hydraulic oil tank through said filter and said check valve.

7. The work vehicle according to claim 1, wherein said hydraulic pump is disposed at a position higher than said filter and said check valve.

8. The work vehicle according to claim 1, further comprising a cab and an engine compartment, wherein said hydraulic oil tank is disposed posterior to said cab and anterior to said engine compartment.

* * * * *